US005768393A

United States Patent [19]

Mukojima et al.

[11] Patent Number: 5,768,393

[45] Date of Patent: Jun. 16, 1998

[54] THREE-DIMENSIONAL SOUND SYSTEM

[75] Inventors: Masahiro Mukojima; Shigemitsu Yamaoka, both of Shizuoka, Japan

[73] Assignee: Yamaha Corporation, Japan

[21] Appl. No.: 554,728

[22] Filed: Nov. 7, 1995

[30] Foreign Application Priority Data

Nov. 18, 1994 [JP] Japan ..... 6-309854

[51] Int. Cl.[6] ..... H04S 5/00

[52] U.S. Cl. ..... 381/17; 463/32; 463/33; 463/35

[58] Field of Search ..... 395/153, 154; 463/32, 33, 35; 381/17

[56] References Cited

U.S. PATENT DOCUMENTS

| | | | |
|---|---|---|---|
| 4,118,599 | 10/1978 | Iwahara et al. . | |
| 4,188,504 | 2/1980 | Kasuga et al. . | |
| 4,219,696 | 8/1980 | Kogure et al. . | |
| 4,817,149 | 3/1989 | Myers | 381/1 |
| 5,046,097 | 9/1991 | Lowe et al. | 381/17 |
| 5,105,462 | 4/1992 | Lowe et al. | 381/17 |
| 5,291,556 | 3/1994 | Gale | 381/17 |
| 5,495,576 | 2/1996 | Ritchey | 395/154 |
| 5,521,981 | 5/1996 | Gehring | 381/17 |

*Primary Examiner*—Forester W. Isen
*Attorney, Agent, or Firm*—Graham & James LLP

[57] ABSTRACT

An object incorporated in image data is formed with a plurality of polygons. An object table defines each polygon by means of coordinates at an apex in a view coordinate system and the sound generated from the polygon. The sound source processor unit controls sound to be generated from each polygon according to the position and direction of the polygon when the object is viewed from a viewpoint.

17 Claims, 3 Drawing Sheets

FIG. 3
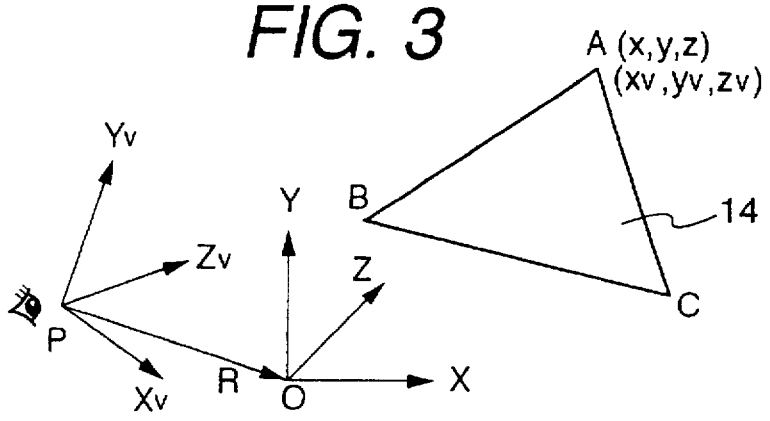
FIG. 4
| POLYGON NO. | 3D COORDINATE OF POLYGON | COLOR | SOUND DATA |
|---|---|---|---|
| 1 | ( x1,y1,z1 ), ( x2,y2,z2 ), ( x3,y3,z3 ), | C1 | S1 |
| 2 | ( x4,y4,z4 ), ( x5,y5,z5 ), ( x6,y6,z6 ), | C2 | S2 |
| 3 | ( x7,y7,z7 ), ( x8,y8,z8 ), ( x9,y9,z9 ), | C3 | S3 |
| | | | |
FIG. 5
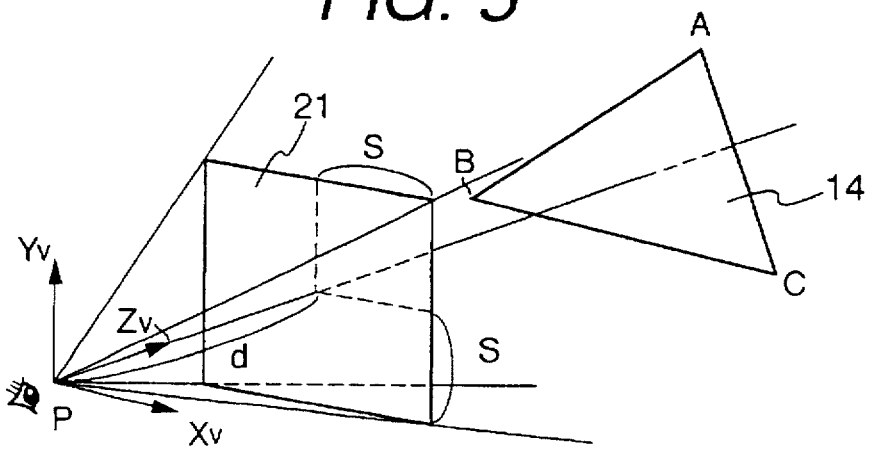

THREE-DIMENSIONAL SOUND SYSTEM

BACKGROUND OF THE INVENTION

1. Field of the Invention

The present invention relates to a three-dimensional sound system for generating sound. More particularly, the invention relates to a three-dimensional sound system for generating sound from a position of a virtual sound source linked with three- or two-dimensional computer graphics (hereinafter called, the "three-dimensional CG") in a personal computer, a game or the like.

2. Related Art

Three-dimensional sound systems are known in which an object on a display is made into a virtual sound source. Three-dimensional CG technology is utilized to regulate a sound image to appear as if it were generated out of the virtual sound source. Such conventional systems are utilized in, for example, video games and computer simulation equipment.

In the conventional three-dimensional CG systems, data on an object constituted by one or a plurality of polygons is retained as three-dimensional object data for each object. When a view point is changed, a host system operates to update the three-dimensional object data. In this case, a special processor takes partial charge of converting the object into a screen coordinate system, so that the switching of the viewpoint can be conducted quickly. The polygon constituting the object is generally triangular, and provides data on the direction of a plane necessary for shading, texture mapping and the like. The smoothness of the display of the curved surface is generally determined by its size.

In the conventional three-dimensional sound system which is linked with three-dimensional CG, on the other hand, the host system calculates position data on the object from the three-dimensional object data, and a sound source processor unit generates a monaural audio signal of a designated type of sound in accordance with the calculated position data and data provided from the host on the type of sound to be generated. Further, the sound source processor unit subjects the monaural audio signal thus generated to certain processing including delay, filtering and amplitude control processing in order to localize a sound image at the position of the virtual sound source by generating a two- or four-channel stereo sound.

It is impossible, however, in the conventional three-dimensional sound system to provide finer or more sensitive control over the way sound is realized in conformity with the direction in which the sound is produced since the three-dimensional sound is generated merely from the position data of the object and the data from the host on the type of sound to be generated. Moreover, the host system has to provide the sound source processor unit with data on the position of the object each time the position of the object is changed, which raises a problem in that the processing load on the host system tends to increase.

SUMMARY OF THE INVENTION

The present invention was developed to avoid the above and other problems which accompany conventional three-dimensional sound systems. Accordingly, it is an object of the present invention to provide a three-dimensional sound system capable of making sound from an object which can be finely and sensitively controlled. Another object of the invention is to provide a three-dimensional sound system which is capable of reducing the processing load on a host system.

The above and other objects can be achieved in accordance with one embodiment of the present invention by the provision of a three-dimensional sound system for localizing a sound source at a predetermined position with an object incorporated in computer image data as a virtual sound source. The three-dimensional sound system includes: an object table for holding coordinates at each apex of a polygon or each of a plurality of polygons constituting the object, and data on sound to be generated from each polygon; and a sound source processor for controlling sound to be generated from each polygon according to i) the position and direction of the polygon when the object is viewed from a selected viewpoint, and ii) the data stored in the object table.

Even when the position of an object remains the same, the way the sound is realized may naturally differ with, for example, a change in the direction in which the polygon as a sound source faces.

The sound in the three-dimensional sound system of the present invention can be controlled in accordance with the direction of the sound generated from the polygon. This is due, in part, to the inclusion of the object table for holding not only coordinates of each apex of one or more polygons which constitute an object, but also data on the type of sound to be generated from each polygon. Further, the sound source processor controls the sound to be generated from each polygon according to the position and direction of the polygon when the object is viewed from a selected viewpoint, in addition to the data from the object table. Thus, it is possible to build a three-dimensional sound system in accordance with the present invention which offers high quality, realistic sound generation.

According to the present invention, the processing load on the host system can also be significantly reduced since the sound source processing means exercises polygon-to-polygon control over sound according to the position and direction of each polygon once the host system provides the data on the sound to the object table.

The above and other objects and advantages of the present invention will become clearer upon a reading of the description of the preferred embodiments of the present invention when considered in conjunction with the drawings, of which the following is a brief description.

BRIEF DESCRIPTION OF THE DRAWINGS

FIG. 3 is a diagram illustrating a method for converting polygon coordinates in an absolute coordinate system to those in a view coordinate system;

FIG. 4 is one example of an object table;

FIG. 5 is a diagram illustrating a method for converting the polygon coordinates in the view coordinate system to those in a screen coordinate system;

DESCRIPTION OF THE PREFERRED EMBODIMENTS

Figure 1:
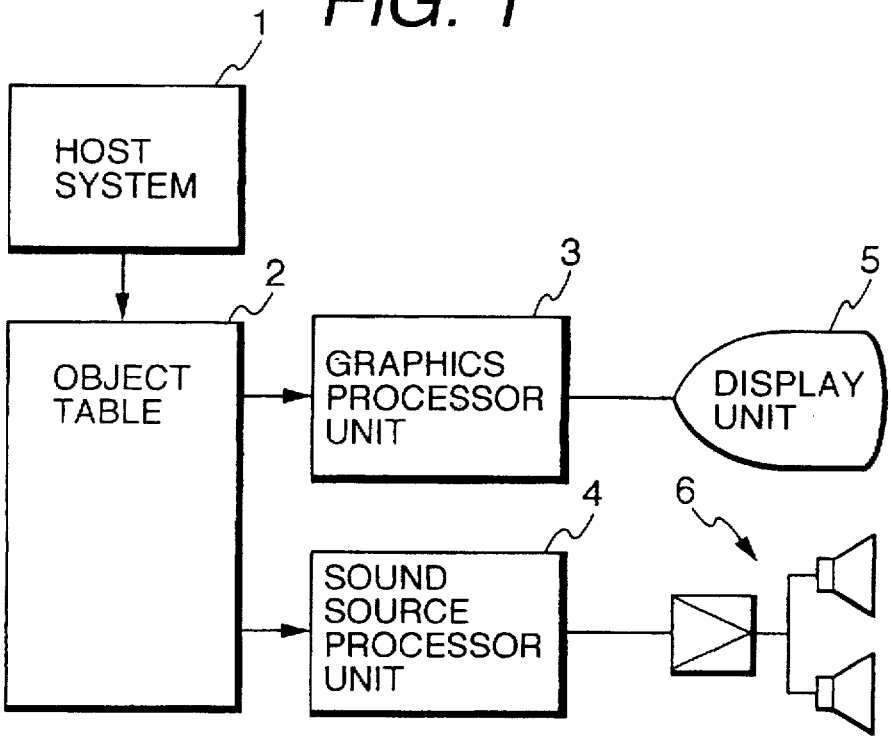
FIG. 1 is a block diagram of one embodiment of a three-dimensional CG sound system in accordance with the present invention.

Referring to the drawings, a preferred embodiment of the present invention will now be described in detail. In the drawings, like reference numbers refer to like elements. It is to be understood that while the drawings are illustrative of the present invention, the invention is in no way limited to the embodiments illustrated in the drawings.

In FIG. 1, a host system 1 may comprise a personal computer, video game device, or other suitable system which can, for example, execute game or computer simulation processing using appropriate software. An object table 2 is used to store three-dimensional coordinate values at every apex of a polygon forming each object in a view coordinate system, display colors, and sound data such as tone color, tone quality, pitch, and the volume of the sound produced in the three-dimensional CG. With respect to the apex coordinate values, the data stored in the object table 2 can be updated in real time by the host system 1 as, for example, the viewpoint alters and/or the object moves.

The data stored in the object table 2 is supplied to a graphics processor unit 3 and a sound source processor unit 4. The graphics processor unit 3 obtains apex coordinates in each screen coordinate system on the basis of the apex coordinates of each polygon in the view coordinate system in the object table 2 and simultaneously performs not only a hidden line or plane elimination process but also the three-dimensional CG processing such as shading texture mapping according to the display colors, so that a three-dimensional image is formed on the screen of a display unit 5.

The sound source processor unit 4 obtains the position of a virtual sound source and the direction of a polygon on the basis of the apex coordinates of each polygon in the object table 2, and causes the sound designated by the sound data to be produced via a sound generating unit 6 in the direction of the polygon from the acquired position of the sound source. In this embodiment of the invention, the sound is generated in accordance with the direction of the polygon for the sake of simplification by controlling the sound amplitude in proportion to the area of the polygon projected onto the screen of the display unit 5.

Figure 2:
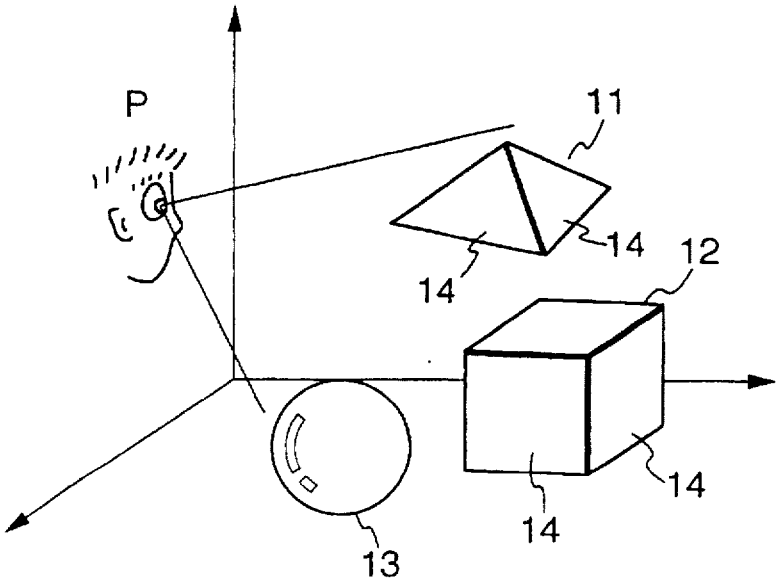
FIG. 2 is a diagram illustrating the relationship between multiple objects in three-dimensional space and view coordinates.

The operation of the system will be described in more detail. FIG. 2 shows the relation between a view point P and objects existing in a three-dimensional space. Objects 11, 12 and 13 are each constituted by a plurality of polygons. Even the object 13 is microscopically expressed as a collection of tiny triangles. The apex coordinates of polygons constituting each of these objects 11, 12 and 13 in an absolute coordinate system X, Y and Z are stored in the host system 1.

Now, as shown in FIG. 3, for example, the origin in the absolute coordinate system is O; unit vectors of the respective axes are X, Y, Z; the origin in the view coordinate system is P; unit vectors of the respective axes are $X_v$, $Y_v$, $Z_v$; a vector from the origin P to the origin O in the view coordinate system is R; a direction cosine matrix between the unit vectors in both coordinate systems is T; and coordinate values of an apex A of the polygon 14 in the view coordinate system are (x, y, z), the coordinate values ($x_v$, $y_v$, $z_v$) at the apex A in the view coordinate system will be given by the following numerical formula (1):

$$[x_v\ y_v\ z_v]=[x\ y\ z]T+[rx\ ry\ rz] \tag{1}$$

where rx, ry, rz are scalars, $$R=rxX_v+ryY_v+rzZ_v$$

The host system 1 calculates the coordinate values ($x_v$, $y_v$, $z_v$) of each polygon in the view coordinate system in accordance with the view point P, the unit vectors $X_v$, $Y_v$, $Z_v$ and the absolute coordinate values (x, y, z) at each apex, and registers the values thus calculated in the object table 2.

FIG. 4 shows an example of the object table 2 formed thereby. The three-dimensional coordinate values at the apex of each polygon in the view coordinate system, the color and sound data on the polygon are stored in the object table 2. Of this data, the three-dimensional coordinate values of the polygon are updated each time the view point and/or the object are moved.

The graphics processor unit 3 converts the coordinates at the apex of the polygon in the view coordinate system to those in a screen coordinate system on the screen of the display unit 5. More specifically, given that the position of a screen 21 upright on the eye line ($Z_v$ axis) is d and that the width of the screen 21 is 2s as shown in FIG. 5, the graphics processor unit 3 subjects the coordinates ($x_v$, $y_v$, $z_v$) of the polygon to conversion as expressed by the following numerical formula (2) to obtain coordinate values (xs, ys, zs) in the screen coordinate system. In this case, w represents a scale factor justifying xs=x/w, ys=y/w, zs=z/w.

$$[x\ y\ z\ w]=[x_v\ y_v\ z_v\ 1]M$$

$$M=\begin{bmatrix}1 & 0 & 0 & 0\\ 0 & 1 & 0 & 0\\ 0 & 0 & 0 & s/d\\ 0 & 0 & -s/d & 0\end{bmatrix} \tag{2}$$

Since the coordinate value zs in the direction of the eye line (in the direction of depth) is included in the coordinate values thus converted, the graphics processor unit 3 performs the hidden line or plane elimination process by determining the size of this zs. Further, the graphics processor unit 3 covers each polygon with the prescribed color and forms an image on the display unit 5 by applying the shading or texture mapping process and the like thereto.

Figure 6:
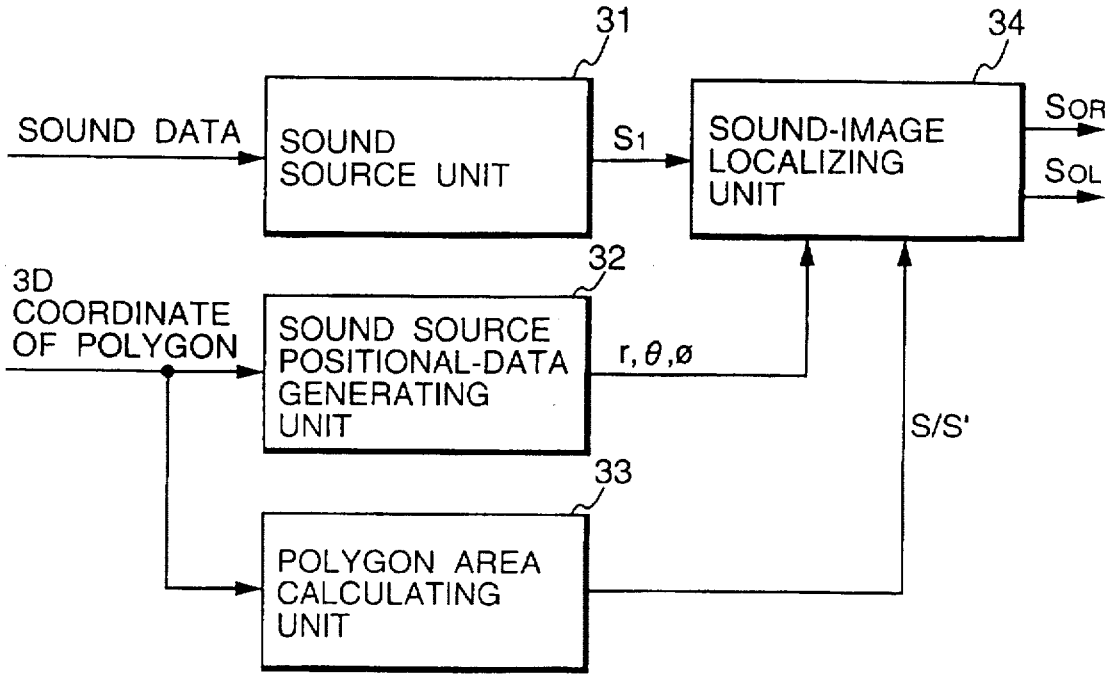
FIG. 6 is a block diagram showing one embodiment of a sound source processor unit in accordance with the present invention.

On the other hand, the sound source processor unit 4 controls the position of the virtual sound source and the sound generated from this position on the basis of the sound data and the three-dimensional coordinates of the polygon. The sound source processor unit 4 is arranged as shown in FIG. 6, for example. More specifically, the sound data is supplied to a sound source unit 31 where a monaural audio signal $S_1$ of tone color, pitch, the type of sound and the volume of the sound designated therein is formed. Moreover, the three-dimensional coordinate values of the polygon are supplied to a sound-source positional-data generating unit 32 and a polygon area calculating unit 33. The sound-source positional-data generating unit 32 calculates the central position of the coordinate values at the apex of the polygon and makes this position a virtual sound source position. The position of the virtual sound source is converted so that it is given by a distance r from the central point (the origin P of the view coordinates) up to the virtual sound source, a horizontal angle (azimuth) θ of the virtual sound source as viewed from the front of a listener, and a vertical angle (elevation) φ as viewed from the angle θ against the front of the listener. Further, the polygon area calculating unit 33 calculates the area of the polygon from the screen coordinates obtained through the same process as noted above or those supplied from the graphics processor unit 3.

Assuming the screen coordinate values at the respective apexes A, B and C of the polygon are (xa, ya, za), (xb, yb, zb) and (xc, yc, zc), respectively, the polygon area calculating unit 33 calculates the area S of the polygon on the screen according to the following numerical formula 3:

$$S = (x_{max} - x_{min})(y_{max} - y_{min}) - \{|xa - xb||ya - yb| + |xb - xc||yb - yc| + |xc - xa||yc - ya|\}/2 \quad (3)$$

where $x_{max}$=maximum value of xa, xb, xc, $X_{min}$=minimum value of xa, xb, xc, $Y_{max}$=maximum value of ya, yb, yc, and $Y_{min}$=minimum value of ya, yb, yc.

The polygon area calculating unit 33 outputs S/S', that is, the ratio of the calculated area S of the polygon to the actual area S' of the polygon. The audio signal $S_1$, the sound-position data r, θ, ϕ and the polygon area S/S' are supplied to a sound-image localizing unit 34.

Figure 7:
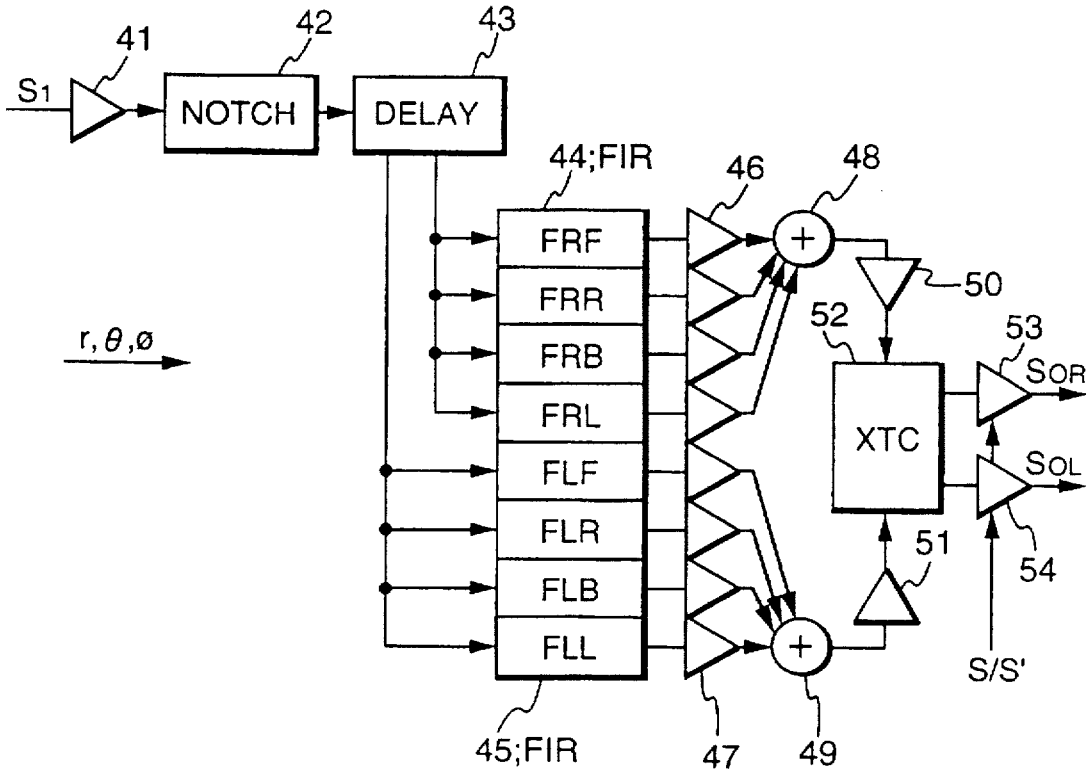
FIG. 7 is a block diagram showing one embodiment of a sound-image localizing unit in the sound source processor unit of the present invention.

FIG. 7 is a block diagram showing an example of the sound-image localizing unit 34 in accordance with the present invention. The monaural audio signal $S_1$ output from the sound source unit 31 is supplied via an amplifier 41 to a notch filter 42. The notch filter 42 bases it on the characteristics of the human auditory sense and/or the influence of the configuration of the human pinna to attenuate a specific frequency component of the audio signal $S_1$ and to provide the input signal $S_1$ with vertically-directed sensitivity, so that the frequency component determined by the elevation ϕ is attenuated. The output of the notch filter 42 is delayed by a delay circuit 43 to provide for a time difference in the propagation of the sound directed from the position of the virtual sound source to both ears, and is converted to a two-channel signal having such a time difference.

The time difference, which is based on the data r, θ, ϕ as to the position of the virtual sound source, is obtained from the difference between distances from the virtual sound source to the both ears of the listener. These signals are each supplied to FIR (Finite Impulse Response) filters 44, 45. The FIR filters 44, 45 measure an impulse response (head transmission function) beforehand when a sound image is localized in every direction, that is, longitudinal and lateral directions, of the listener by means of dummy heads. The filters 44, 45 generate signals of four-directional components out of the input signal.

The outputs of the FIR filters 44, 45 are synthesized by amplifiers 46, 47 and adders 48, 49 so that sound comes from the position of the designated virtual sound source, and the lateral amplitude balance based on the direction of the virtual sound source is regulated by amplifiers 50, 51. With respect to the outputs of the amplifiers 50, 51, stroke components each arriving at the left-hand ear from a right-hand speaker and arriving at the right-hand ear from a left-hand speaker are removed by a stroke canceler 52 first, and the control of the amplitude is exercised by amplifiers 53, 54 on the basis of the distance up to the virtual sound source. At this time, the amplifiers 53, 54 restrict the amplitude of the audio signal in proportion to the area ratio S/S' with respect to a reference area of the polygon calculated by the polygon area calculating unit 33. The signals in the respective channels are subjected to these processes before being output as audio output signals SOR, SOL.

With the system as described above, the maximum sound volume is attained when the polygon is directed to the front, whereas the volume is reduced as the direction of the polygon goes wide of the front since the amplitude of the sound generated out of the virtual sound source is regulated by the area of the polygon as viewed from the view coordinate system. Accordingly, three-dimensional sound control can be exercised with the above-described system so as to closely simulate the generation of an actual sound in three-dimensional space.

Further, as data on the sound produced from the polygon together with the coordinates of the apex of the polygon is stored in the object table 2, it is not necessary for the host system 1 to frequently supply the position of the virtual sound source to the sound source processor unit 4. As such, the processing load on the host system is greatly reduced.

Although a description has been given in the above-described embodiment of the present invention of the case where the sound generated from one polygon is controlled, it should be understood that a plurality of sound sources may be provided for one object. Moreover, transmission functions, sound reflectance and the like may also be incorporated in the sound data registered in the object table.

As set forth above, the sound system according to the present invention includes the object table for holding not only coordinates at each apex of one or more polygons constituting an object, but also data on sound to be generated from each polygon. The sound source processing means controls sound to be generated from each polygon according to the position and direction of the polygon when the object is viewed from a selected viewpoint as well as the data in the object table. Accordingly, the way the sound is realized can be controlled in accordance with the direction of the sound generated from the polygon. Thus it is possible to build a three-dimensional sound system offering realistic sound generation.

Moreover, the processing load on the host system is also reduced by a large margin since the sound source processing means exercises polygon-to-polygon control over sound according to the position and direction of each polygon once the host system provides the data on the sound to the object table.

Of course, one skilled in the art will readily recognize that numerous modifications and/or additions may be made to the above-described embodiments of the present invention without departing from the spirit and scope thereof. It is intended that all such modifications and/or additions fall within the scope of the present invention which is best defined by the claims which appear below.

What is claimed is:

1. A three-dimensional sound system for localizing a sound source at a predetermined position with an object constituted by at least one polygon as a virtual sound source, said object being incorporated in computer image data, the system comprising:

a host system for generating viewpoint position data indicative of a viewpoint of said object and object position data indicative of a position of said object;

an object table responsive to said host system for storing three-dimensional coordinate values of every apex of said polygon in a view coordinate system, and sound data to be generated from said polygon; and sound source processing means for responsive to said sound data controlling sound to be virtually generated from said polygon in correspondence with a position and direction of said polygon according to data stored in said object table when said object is viewed from said viewpoint.

2. The three-dimensional sound system of claim 1, further comprising a graphics processor unit for determining apex coordinates in a screen coordinate system on the basis of apex coordinates of said polygon in the view coordinate system stored in said object table, said graphics processor unit forming a three-dimensional image of said object on a screen of a display unit.

3. The three-dimensional sound system of claim 1, wherein said sound source processing means comprises:

a sound source unit for inputting said sound data stored in said object table;

generating means for generating sound-source position data in accordance with said three-dimensional coordinate values stored in said object table;

polygon calculating means for calculating a polygon area in accordance with said three-dimensional coordinate values stored in said object table; and a sound-image localizing unit for generating a sound of said polygon corresponding to at least one of a position and direction of said polygon when said object is viewed from said viewpoint in accordance with outputs of said sound source unit, said generating means and said polygon calculating means.

4. The three-dimensional sound system of claim 3, wherein said sound-source position data includes a distance from a central point to said virtual sound source, a horizontal angle of said virtual sound source as viewed from a front of a listener, and a vertical angle as viewed from a horizontal angle in front of the listener.

5. The three-dimensional sound system of claim 1, wherein a single object in said image includes a plurality of sound sources.

6. The three-dimensional sound system of claim 1, wherein said object table further includes data indicative of at least one of transmission functions and sound reflectance.

7. A method for associating a sound source with an object at a predetermined position in a computer image, said object being comprised of at least one polygon, said method comprising the steps of:

generating viewpoint position data indicative of a viewpoint of said object and object position data indicative of a position of said object;

providing an object table for storing three-dimensional coordinate values of every apex of said polygon in a view coordinate system, and sound data to be generated from said polygon; and controlling sound to be virtually generated from said polygon in correspondence with a position and direction of said polygon according to data stored in said object table when said object is viewed from said viewpoint.

8. The method of claim 7, further comprising a steps of:

determining apex coordinates in a screen coordinate system on the basis of said three-dimensional coordinate values of every apex of said polygon stored in said object table; and forming a three-dimensional image of said object on a screen of a display unit.

9. The method of claim 7, further comprising the steps of:

inputting said sound data stored in said object table;

generating sound-source position data in accordance with said three-dimensional coordinate values stored in said object table;

calculating a polygon area in accordance with said three-dimensional coordinate values stored in said object table; and generating a sound of said polygon corresponding to at least one of a position and direction of said polygon when said object is viewed from said viewpoint in accordance with at least one of said sound data, said sound-source position data, and said calculated polygon area.

10. The method of claim 9, wherein said sound-source position data includes a distance from a central point to said virtual sound source, a horizontal angle of said virtual sound source as viewed from a front of a listener, and a vertical angle as viewed from a horizontal angle in front of the listener.

11. The method of claim 7, wherein said object table further includes data indicative of at least one of transmission functions and sound reflectance.

12. A three-dimensional sound system for localizing a sound source as represented by an object at a predetermined position that is incorporated in computer image data as a virtual sound source, said object constituted by at least one polygon, the system comprising:

a computer system for generating viewpoint position data indicative of a viewpoint of said object and object position data indicative of a position of said object;

an object table responsive to said computer system for storing three-dimensional coordinate values of every apex of said polygon in a view coordinate system, and sound data to be generated from said polygon; and sound source processing means responsive to said sound data for controlling sound to be virtually generated from said polygon in correspondence with a position and direction of said polygon according to data stored in said object table when said object is viewed from said viewpoint.

13. The three-dimensional sound system of claim 12, further comprising a graphics processor unit for determining apex coordinates in a screen coordinate system on the basis of apex coordinates of said polygon in the view coordinate system stored in said object table, said graphics processor unit forming a three-dimensional image of said object on a screen of a display unit.

14. The three-dimensional sound system of claim 12, wherein said sound source processing means comprises:

a sound source unit for inputting said sound data stored in said object table;

generating means for generating sound-source position data in accordance with said three-dimensional coordinate values stored in said object table;

polygon calculating means for calculating a polygon area in accordance with said three-dimensional coordinate values stored in said object table; and a sound-image localizing unit for generating a sound of said polygon corresponding to at least one of a position and direction of said polygon when said object is viewed from said viewpoint in accordance with outputs of said sound source unit, said generating means and said polygon calculating means.

15. The three-dimensional sound system of claim 14, wherein said sound-source position data includes a distance from a central point to said virtual sound source, a horizontal angle of said virtual sound source as viewed from a front of a listener, and a vertical angle as viewed from a horizontal angle in front of the listener.

16. The three-dimensional sound system of claim 12, wherein a single object in said image includes a plurality of sound sources.

17. The three-dimensional sound system of claim 12, wherein said object table further includes data indicative of at least one of transmission functions and sound reflectance.

* * * * *